US005197937A

United States Patent [19]

Dalrymple

[11] Patent Number: 5,197,937

[45] Date of Patent: Mar. 30, 1993

[54] DIFFERENTIAL AIR PRESSURE CARTON TRANSFER APPARATUS AND METHOD

[75] Inventor: Bruce H. Dalrymple, Decatur, Ga.

[73] Assignee: Kliklok Corporation, Decatur, Ga.

[21] Appl. No.: 941,858

[22] Filed: Sep. 8, 1992

Related U.S. Application Data

[63] Continuation of Ser. No. 727,670, Jul. 9, 1991, abandoned.

[51] Int. Cl.[5] ..... B31B 3/44; B31B 1/48

[52] U.S. Cl. ..... 493/167; 497/182; 198/689.1; 414/752

[58] Field of Search ..... 493/147, 167, 182; 198/689.1, 836.2; 414/752

[56] References Cited

U.S. PATENT DOCUMENTS

| | | | |
|---|---|---|---|
| 2,277,289 | 3/1942 | Bergstein et al. | 493/472 |
| 2,568,382 | 9/1951 | Buckley et al. | 493/110 |
| 2,608,915 | 9/1952 | Bickford | 493/167 |
| 2,958,267 | 11/1960 | Wolff et al. | 493/472 |
| 3,352,404 | 11/1967 | Di Settembrini | 198/689.1 |
| 3,602,108 | 8/1971 | Vulleumier | 493/167 |
| 4,252,052 | 2/1981 | Meyers et al. | 493/167 |
| 4,464,155 | 8/1984 | Collura et al. | 493/137 |

*Primary Examiner*—William E. Terrell
*Attorney, Agent, or Firm*—King & Schickli

[57] ABSTRACT

An apparatus and method for forming flat-out carton blanks into erected cartons and transferring the cartons from a forming head to a takeaway conveyor is disclosed. The apparatus includes a forming die with forming guides to receive the head and erect the carton side panels to an upright position relative to the carton bottom panel. Presser fingers pivotally secured to the forming guides transfer the erected carton away from the forming head. A differential air pressure source provides negative pressure to a manifold below the conveyor and against the bottom of the carton, and positive pressure through a nozzle to the top. This action efficiently transfers the carton to the takeaway conveyor and assures firm seating of the carton on the conveyor.

7 Claims, 4 Drawing Sheets

DIFFERENTIAL AIR PRESSURE CARTON TRANSFER APPARATUS AND METHOD

This is a continuation, of application Ser. No. 07/727,670, filed Jul. 9, 1991, now abandoned.

BACKGROUND OF THE INVENTION

This invention relates generally to an apparatus and method for forming flat-cut paperboard carton blanks into erected cartons, and more particularly, to an improved apparatus and method for transferring the erected cartons from a forming station to a takeaway conveyor.

Apparatus is known for forming flat-cut carton blanks into erected cartons. The paperboard carton blanks are generally of rectangular configuration having a bottom panel and opposing side and end panels connected therewith along fold lines. Locking tabs are provided on the end panels for engagement with slits provided on the side panels during the forming operation. Alternatively, the erected carton may be of the heat-seal type, as is also well known. Locking tabs on the panels, or the heat sealed panel areas, serve to maintain the cartons, with or without hinged covers, in erected condition for subsequent filling, lidding and/or closing operations.

In known carton forming apparatus, typically a feeder mechanism deposits a carton blank onto a die. A forming head, or plunger, of rectangular configuration corresponding to the erected carton size, then engages the carton bottom panel to force the blank in a descending forming stroke through the die. The die includes forming guides engaging the carton sides and end panels during passage of the forming head through the die. In this manner, the carton side and end panels bend along their fold lines into upright position relative to the carton bottom panel, and into engagement with the corresponding end and side walls of the forming head. The die also includes tab stripper members to force or strip the locking tabs into the slits. Alternatively, on heatseal cartons, hot air nozzles activate the plastic coating for sealing.

During further operation, the forming head descends completely through the die, where the spring loaded presser fingers, such as the type disclosed in U.S. Pat. No. 4,464,155 to Collura et al. (owned by the assignee of the present invention) are positioned to project slightly into the path of the forming head. As the forming head descends into an end-of-stroke position, the presser fingers snap past the carton side panels. Thereafter, the forming head ascends to receive the next in-line carton blank, and as it does the upper edges of the side panels are engaged by the bottom edge of the fingers. Since the carton is now positively arrested by the fingers, it is stripped from the forming head and dropped by gravity onto a takeaway conveyor below.

Due to this drop from the forming head, the relatively light weight carton characteristically bounces upon striking the conveyor. Because of this bounce, the cartons occasionally become misaligned, or tip over, usually resulting in a carton jam and the operator having to stop the machine. This problem is compounded if the bouncing carton is struck by one of the conveyor flights (pusher lugs attached to the conveyor chains) while bouncing.

Several methods and devices have been employed to alleviate this problem. One of the more successful approaches incorporates the use of suction cups on an oscillating picker arm. The suction cups, attached to a suitable vacuum source through a conduit or hose, engage the bottom of the erected container, and then the arm lowers it in a timed and controlled manner from the forming head. U.S. Pat. No. 3,602,108 to Vuilleumier discloses an apparatus of this type. The problem with this, or similar configurations, is that the takeaway conveyor, and thus the downstream portion of the packaging line must be slowed to allow the picker arm time to carry out its function in coordination with the forming head. This arrangement not only thus limits the output of the packaging system, but also increases the initial cost and the maintenance requirements.

SUMMARY OF THE INVENTION

Accordingly, it is a primary object of the present invention to provide an improved method and apparatus for transferring erected paperboard cartons from the forming head to the takeaway conveyor in a packaging system.

Another object is to provide a method and apparatus for transferring erected cartons using a positive/negative air pressure source in combination with an exhaust nozzle and intake ports of a manifold, respectively, to effect efficient carton transfer and holddown on the takeaway conveyor.

Another object is to provide an apparatus for transferring erected cartons from the forming head, not only at an increased rate, but also at a lower cost.

Still another object is to provide an apparatus for transferring the erected cartons of a paperboard carton forming machine from the forming head to a relatively high-speed takeaway conveyor, and to do so with a reduced mechanism/method of complexity.

Yet another object of the present invention is to provide an improved method and apparatus for transferring the erected cartons from the forming head to the takeaway conveyor in a more controlled fashion where bouncing and tipping are avoided, thus resulting in improved carton holddown and fewer conveyor jams and system downtime, thereby increasing production efficiency.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for forming flat-cut paperboard carton blanks into erect cartons and transferring the erected cartons to a relatively high speed takeaway conveyor. The apparatus includes a carton forming head reciprocating through a die at a forming station. During the descending stroke, the forming head engages a carton blank and directs the same through the die where forming guides bend the carton side panels and end panels into upright position relative to the carton bottom panel.

A plurality of spring loaded presser fingers may be pivotally secured to the lower edges of the forming guides. Each finger is biased inwardly, extending into the path of the forming head and engaging the carton side panels during descending movement of the forming head. The fingers act with sufficient force against the fold line of the carton side panels so as to over bend the panels into engagement with the sides of the forming head. As the forming head descends to its lowest point, the top edges of the carton side panels descend below the fingers and snap outwardly for release. The fingers then pivot inwardly such that they extend across the projected path of the top edges of the erected carton.

The forming head begins its ascending stroke, and the top edges of the carton side panels contact the bottom edges of the inwardly extending fingers. As the forming head is retracted, the surrounding carton is stripped from the head by the fingers. Once the erected carton is released from the head it is transferred to the takeaway conveyor, in an improved manner, as described in detail below.

The takeaway conveyor preferably includes a pair of parallel endless chains. Conveyor flights are attached to these chains according to a predetermined spacing. As the conveyor chains travel, the flights contact the erected carton to transport it away from the forming station for further processing, such as at a filling and closing station (not shown).

A differential air pressure source or blower provides the motive force for the improved transfer function for the carton, as mentioned above. The blower provides cooperating positive and negative air pressure against the erected carton along the defined transfer path. As a result, the carton transfers from the head in a more rapid, as well as in a positive and controlled fashion.

The intake of the blower is connected to a manifold located just below the upper run of the conveyor chains, and beneath the forming head. The upper surface of this intake manifold includes a plurality of orifices or ports providing for the air intake. The constant air intake through these orifices results in establishing and maintaining a downwardly directed air flow in the ambient region along the transfer path between the forming die and the takeaway conveyor. This downward air flow supplies the negative pressure to the bottom of the erected carton, thereby assisting the carton in its rapid, but controlled release from the forming head and then seating on the takeaway conveyor.

The exhaust of the blower communicates through a line to a nozzle mounted within the forming head. The nozzle is centered, such that positive downward air flow is directed substantially axially to provide the additional transfer assistance for the carton. The resulting air flow applies a positive air pressure to the erected carton from above, which cooperates with the negative air pressure from below. The result is maximum differential pressure assistance. This arrangement not only makes for a more efficient carton transfer function, but also provides improved seating of the carton on the takeaway conveyor. This assures against bouncing or tipping of the carton as it comes to rest. Thus, the overall operation of the packaging system is improved since the carton transfer is not only faster and more controlled, but down time due to carton jams is practically eliminated.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporate in and forming a part of the specification, illustrate several aspects of the principal invention, and together with the description serve to explain the principals of the invention. In the drawings.

DETAILED DESCRIPTION OF THE INVENTION

Figure 1:
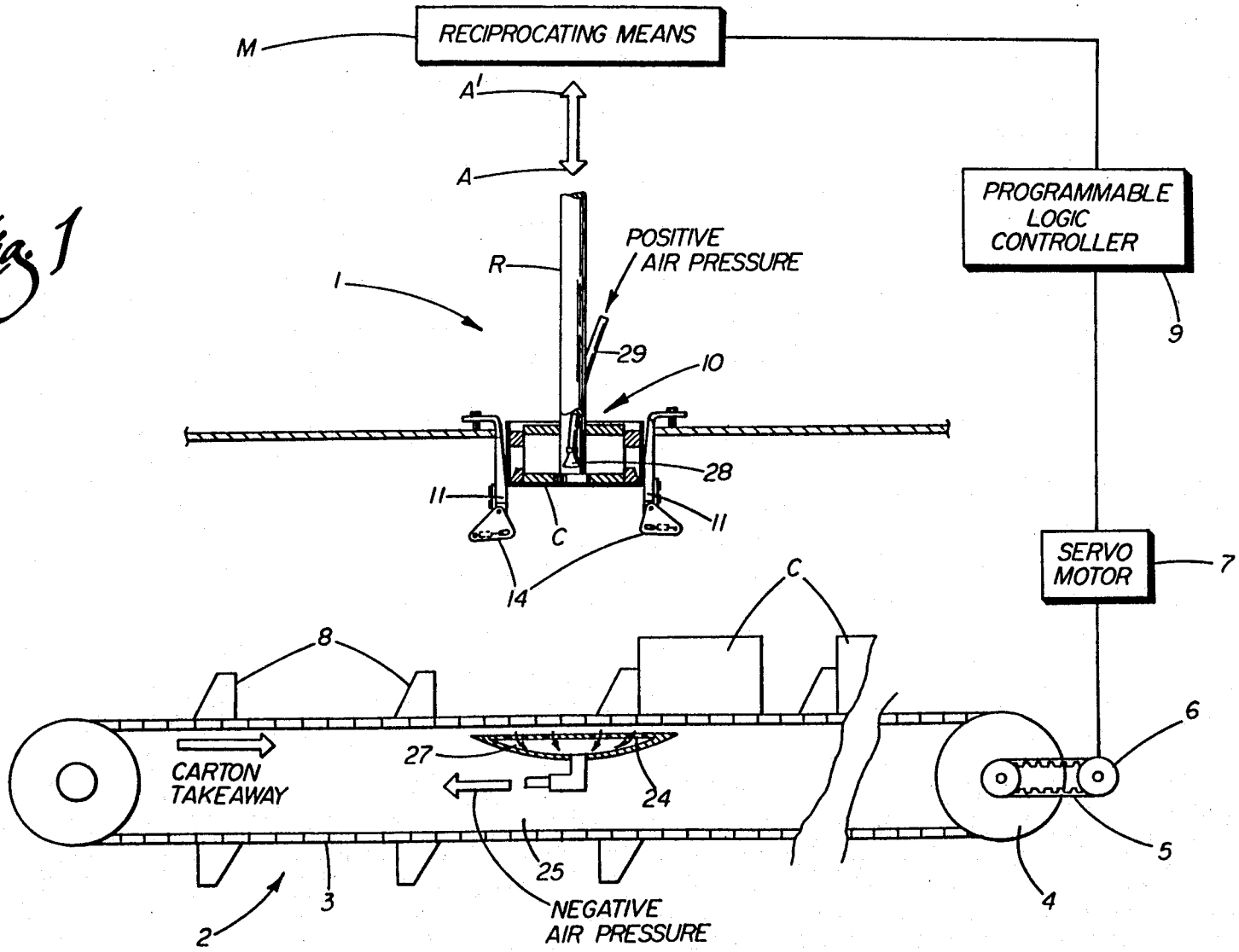
FIG. 1 is a side view representation of the apparatus, showing the relative positioning of the exhaust nozzle and intake manifold to the forming station and takeaway conveyor.
Figure 3:
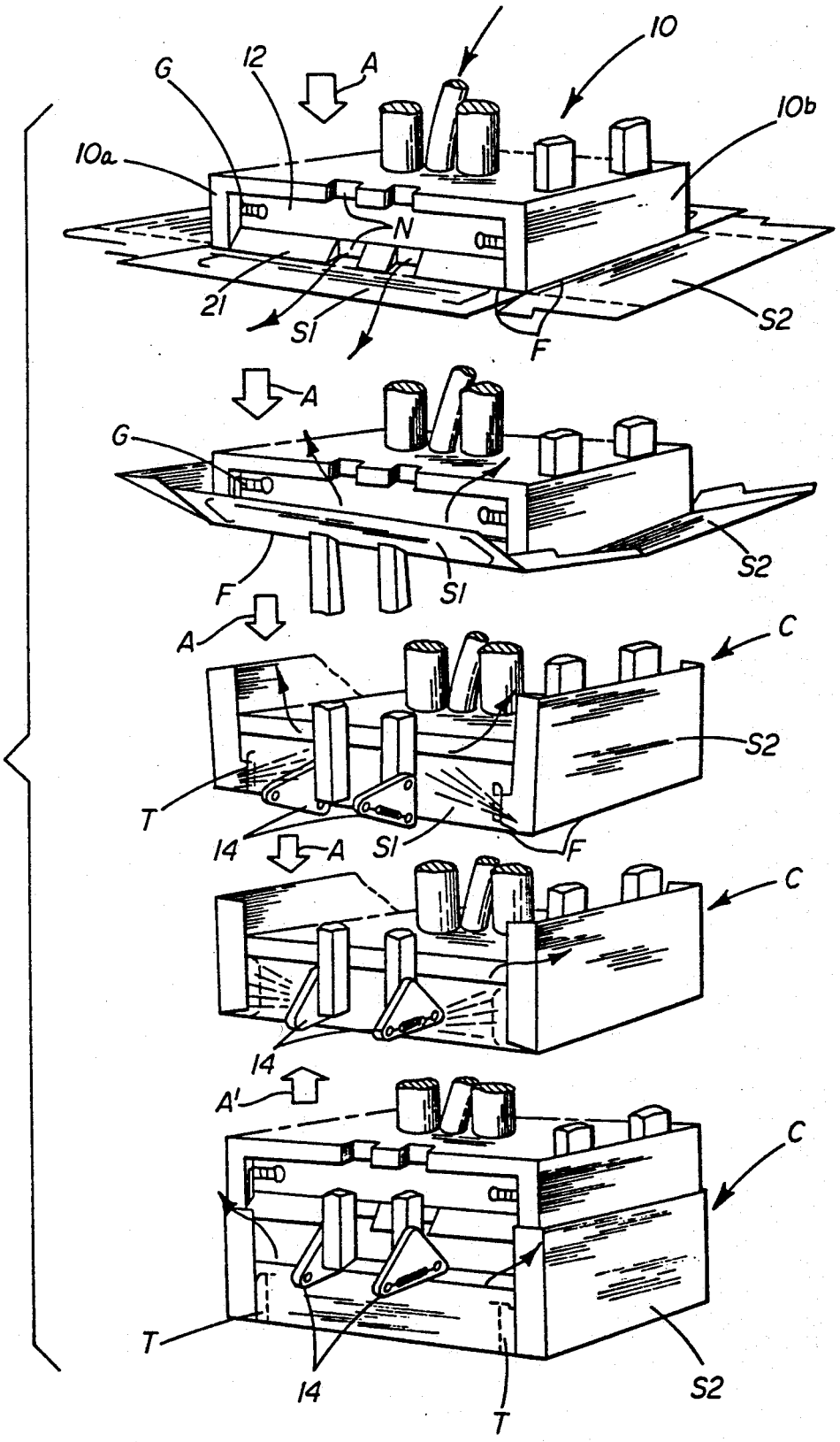
FIG. 3 is a series of perspective views of the forming head, showing progressive locations of the forming head and the carton during the descending forming stroke in relation to the presser fingers and stripping of the carton on the ascending stroke.

Referring to composite FIGS. 1 and 3, a forming station, generally designated by reference numeral 1, is used to form erected cartons C from flat-cut carton blanks. The cartons C are usually plastic coated paperboard, for packaging frozen foods or the like, and include opposing pairs of side panels S1 and relatively shorter end panels S2 connected to a bottom panel B along fold lines F.

A takeaway conveyor, designated by reference numeral 2, transports the erected cartons C from the forming station 1 to subsequent stations for further processing. The takeaway conveyor 2 includes a pair of parallel endless chains 3 driven by a sprocket assembly 4. The sprocket assembly 4 is rotated by a drive belt 5 in combination with a drive shaft 6 and servo motor 7.

Conveyor flights 8 are periodically located along the pair of conveyor chains 3. These conveyor flights 8 contact the erected carton C and transport it along with the conveyor travel. The spacing of the conveyor flights 8 insures proper spacing between subsequent erected cartons C.

A programmable logic controller 9 is used to provide the system control and synchronization. The programmable controller is electrically connected to both the servo motor 7 and the reciprocating means M, such that reciprocation of the forming head can be coordinated with the relative position of the conveyor flights.

Referring to FIG. 3, a forming head 10 is used to direct a flat-cut paperboard carton blank through a suitable die to form the erected cartons C. The forming head 10 is supported by drive rods R and includes a pair of side walls 10*a* and end walls 10*b* corresponding respectively to the carton side panels S1 and end panels S2. The walls 10*a* and 10*b* of the head define a generally rectangular block with an underside corresponding to the carton bottom panel B (see FIG. 4).

The reciprocating means M (as shown in FIG. 1) drives the forming head 10 by engagement through the rods R in a descending stroke, as indicated by arrow A (see particularly FIGS. 3 and 4), to direct the blank through the die and form the erected carton C. An ascending return stroke (see arrow A' in FIGS. 1 and 5), thereafter returns the forming head 10 to an upper carton blank receiving position for erecting the next in-line blank.

In the uppermost position, a carton blank is positioned in the path of forming head 10 by a suitable feeder mechanism (not shown). The carton inside of the bottom panel B is engaged by the underside of the head as the head begins its descending stroke for carton forming.

Figure 4:
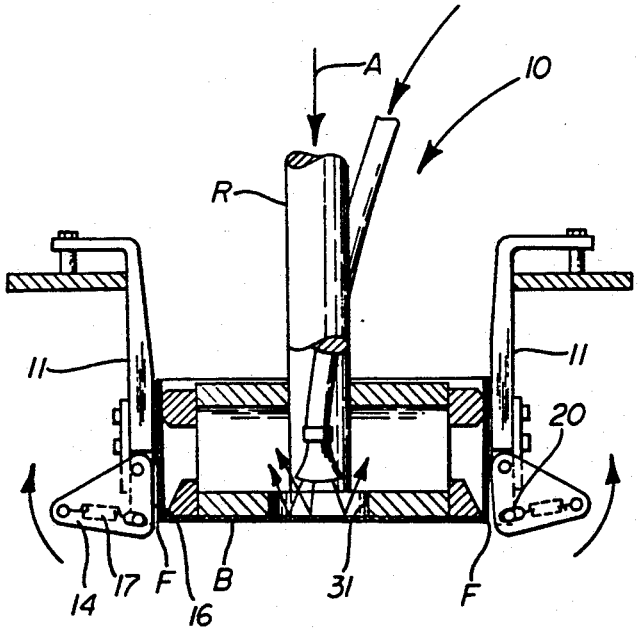
FIG. 4 is a cross-sectional view of the forming head in an intermediate position descending through the forming guides, showing deflection of the presser fingers caused by initial engagement with the carton side panels (cf. third sequential view of FIG. 3)

As best shown in FIG. 1 and in FIG. 4, the die includes a plurality of side forming guides 11 defining the forming path. The guides 11 are substantially parallel to the forming head side walls 10*a*, 10*b*. As the forming head 10 descends between guides 11, the flat carton side panels S1, S2 engage these guides and are forced upwardly into upright erected condition relative to bottom panel B, along the fold lines F. Stripping members G strip or pull the locking tabs T into the slits provided on the panels S1 (see FIG. 3) to hold the carton C erect.

A rectangular cut-out opening 12 is provided in each forming head side wall 10A. Cut-out openings 12 advantageously provide space to allow the erected side panels S1 to bend inwardly from fold lines F, into the openings, when the side panels are engaged by presser fingers 14. This provides an overbreaking action of the side panels S1 at the fold lines F so that when released the panels return to be substantially perpendicular.

The presser fingers 14 are substantially triangular and pivotally connected to forming guide 11 (see FIG. 4). An inwardly directed pressing edge 16 projects slightly into the forming head path under the tension force of a spring 17.

In operation, each pressing edge 16 is biased inwardly into the forming head path by the spring 17 as the carton C begins to form. As carton C continues to descend, the pressing edge 16 continues to bend side panels S1 inwardly into openings 12, so that the side panels are forced to over bend. As the forming head 10 reaches the bottom of its descending stroke, the upper edges of the carton side panels S1 descend below the presser fingers 14. The spring 17 then biases the presser fingers 14 to pivot into the return path of the forming head 10 so that the lower edges are positioned in the return path of the erected carton. Thereafter, ascending return movement of the forming head 10 allows fingers 14 to strip the erected carton C from the forming head for transfer along the path to the conveyor 2 below.

Figure 2:
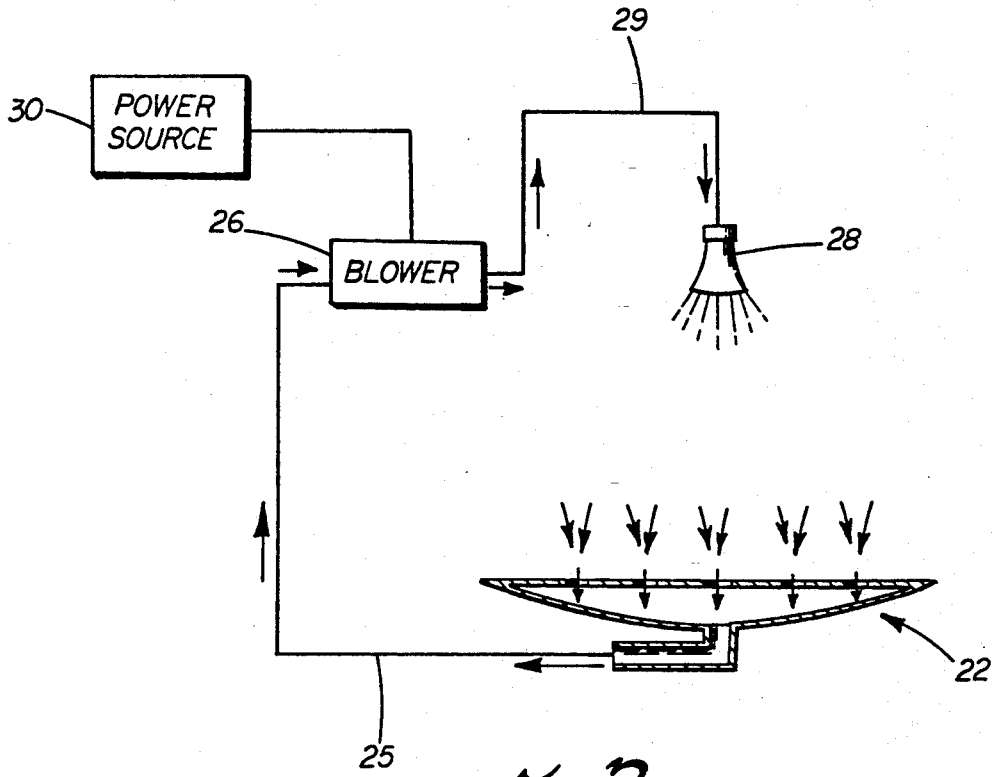
FIG. 2 is a schematic representation of the differential pressure system, showing the line connections of the blower to the intake manifold and exhaust nozzle.

In accordance with the present invention, an intake manifold 22 is located just below the upper run of the conveyor chains 3 and directly underneath the forming station 1 and in alignment with the flow path. The upper surface of the manifold 22 includes a plurality of orifices 24. A vacuum line 25 connects the manifold 22 to the intake of a vacuum source. The vacuum source is preferably a blower 26 or other device capable of generating a suction force at its intake port (see FIG. 2).

Air is drawn in from ambient space below the forming station 1 through the orifices 24 into manifold plenum 27, then through the vacuum line 25 to the blower 26. This intake of air generates a downwardly directed and defined air flow substantially within the ambient air space between the forming station 1 and the takeaway conveyor 2. This air flow defines the transfer path of relatively wide proportions; at least an area the size of the carton C (see FIG. 5). It imparts a negative air pressure P' to the underside of the erected carton C to move the carton in a positive manner along the path, and thus assists its transfer to the conveyor. Further, once the erected carton C strikes the chains 3 of the takeaway conveyor 2, this air flow acts as a retainer to firmly seat and thus prevent the relatively lightweight carton C from bouncing or tipping (see FIG. 5).

In accordance with another feature of the invention, a positive air pressure P is applied to the upper side of the erected carton C. This air pressure is generated by a nozzle 28 connected to the exhaust port of the blower 26 via a pressure line 29. A suitable electrical power source 30 is provided for the blower 26. It should be appreciated that by supplying the positive air pressure P and the negative air pressure P' from the same source, power consumption is minimized, thereby resulting in energy-efficient operation.

The nozzle 28 is located within the forming head 10 in the preferred embodiment shown; although it should be recognized that in accordance with the broad aspects of the invention other locations along the side of the forming guides 11 could be used. An opening 31 is provided in the center of the forming head 10 to allow the positive air pressure P to communicate from the nozzle 28 to the upper side of the erected carton C. Preferably, the air stream from the nozzle 28 is relatively narrow and directed substantially downward toward the takeaway conveyor 2 along the center axis of the carton C and along the transfer path.

During normal operation, the blower operates continuously and the air stream from the nozzle 28 and the flow of air to the manifold 22 helps to stabilize the carton blank throughout the operation, including while positioned on the face of the forming die just prior to initiating the downward stroke of the head 10. The downward force of the forming head 10, as it descends through the die, provides sufficient opposing force to prevent the air pressure from prematurely ejecting the carton from the forming die.

Advantageously, once the erected carton C is stripped from the forming head 10 at the bottom of the die, so as to be free to move toward the takeaway conveyor 2 below, it immediately accelerates due to the built up positive pressure from the nozzle 28, and the negative pressure below provided by the manifold 22.

Figure 5:
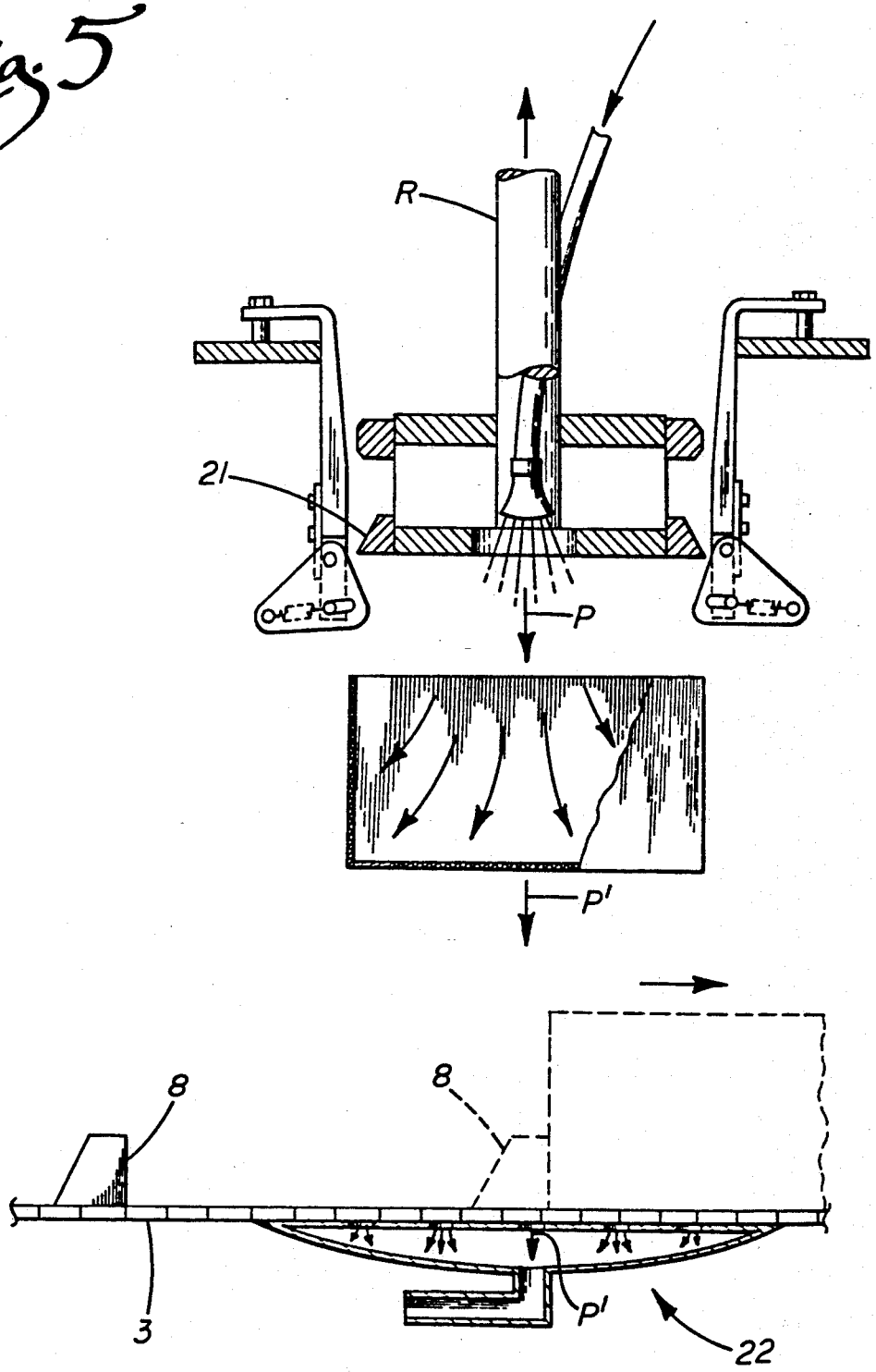
FIG. 5 is a view similar to FIG. 4, but with the forming head retracted from the erected carton and the air flow from the exhaust nozzle and intake ports of the manifold imparting a positive transfer force upon the carton and firm seating on the conveyor.

FIG. 5 illustrates this differential (positive/negative) air pressure that is exerted on the erected carton C as it is ejected from the die and descends toward the conveyor 2. The nozzle 28 exerts a defined stream of positive air pressure P against the upper side of the erect carton C. The air suctioned through the intake manifold 22 exerts a more generalized, relatively wide area air flow and negative pressure P' on the bottom side of the carton. This differential pressure is uninterrupted and exerts a holding force on the carton C as it strikes the conveyor 2 to prevent it from bouncing or tipping. The carton C is firmly seated in position below the forming station 1 as the conveyor flights 8 engage it for transport to the next station for further processing.

The differential pressure provided by P, P' may be regulated by simply controlling the speed/capacity of the blower 26. The optimum air flow above and/or below the carton C is selected to provide a rapid transfer from the forming die to the conveyor 2, but at the same time in such a manner so as to maintain controlled movement. The advantage of providing a simple, low cost apparatus with no mechanical parts engaging the carton C is fully realized with the invention.

It should now be realized that the takeaway conveyor 2 can run at an increased speed over that possible in the past, because of the more rapid carton transfer and reliable seating or holding function, thus enhancing the overall packaging operation. The relatively lightweight carton C is no longer susceptible to bouncing or tipping, thus virtually eliminating the problem of carton jams, and resulting machine down time.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the manifold 22 may be employed in some packaging setups independently of the nozzle 28, and vice-versa. In all cases, the positive/negative or differential pressure above/below the carton C is selected to give the optimum transfer speed consistent with maintaining full control of the carton movement. Also the positive air pressure P could be fine tuned by inserting a variable bleeder valve in line 29 to control air flow from the nozzle 28. As the bleeder valve is opened, the resulting positive air pressure P is decreased. The negative air pressure P could be similarly fine tuned by a bleeder valve along line 25.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. In an apparatus including a plunger and die at a forming station for forming carton blanks into erect cartons having side and end panels attached to a bottom panel along fold lines therebetween, and a takeaway conveyor for transporting said erect cartons for further processing, the improvement comprising:

means to transfer the erect carton in ambient air along a defined path including dropping by gravity onto said conveyor from the forming station, a differential air pressure source, means to generate from said pressure source a flow of air extending from the direction of the plunger to the conveyor to facilitate carton transfer along the transfer path in ambient air and toward said conveyor, and means on said takeaway conveyor for positively transporting and spacing said cartons, whereby to assist the erected carton in a positive manner to move along said path from the forming station and to firmly seat said carton on said conveyor and resist substantial tipping so that said carton may be transported for further processing.

2. In an apparatus for processing cartons as claimed in claim 1, wherein said means to generate air flow comprises a vacuum manifold below said conveyor and aligned with said path to assist moving said carton from below.

3. In an apparatus for processing cartons as claimed in claim 2, wherein said conveyor is endless having an upper run crossing said transfer path, and said manifold includes an upper surface below the upper run of said conveyor and having a plurality of intake orifices providing a relatively wide area of air flow along said path.

4. In an apparatus for processing cartons as claimed in claim 1, wherein said means to generate air flow comprises a nozzle above said conveyor and aligned with said path providing a defined air stream to assist moving said carton from above.

5. In an apparatus for processing cartons as claimed in claim 1, wherein said means to generate air flow comprises a vacuum manifold below said conveyor and aligned with said path to assist moving said carton from below, and a nozzle above said conveyor and aligned with said path providing a defined air stream to assist moving said carton from above.

6. In an apparatus for processing cartons as claimed in claim 5, wherein said differential air pressure source comprises a blower, said vacuum manifold being connected to the negative air pressure side and said nozzle being connected to the positive air pressure side of said blower and providing air flow along said flow path for moving said carton.

7. In an apparatus for processing erect cartons having side and end panels attached to a bottom panel along fold lines therebetween, said apparatus having a die, a forming head with corresponding side and end walls at a forming station, reciprocating means for moving the forming head to direct a carton blank through the die into erected condition, with the side panels of the carton engaging the side walls of the head, means for transferring said erect carton away from said forming head and in ambient air along a transfer path from said forming station including dropping by gravity, and a takeaway conveyor for transporting said erect carton for further processing, the improvement comprising:

a vacuum manifold below said conveyor and aligned with said path to assist moving said carton in ambient air from below, a nozzle located in said forming head to provide a one-way positive air flow directed substantially downward along said path toward said conveyor to assist moving said carton in ambient air from above;

a blower, said vacuum manifold being connected to the negative air pressure side and said nozzle being connected to the positive air pressure side of said blower, said vacuum manifold and said nozzle providing coacting air flow along said flow path for moving said carton, whereby to assist the erected carton in a positive manner to move along said path from said forming station and to firmly seat said carton on said conveyor so that said carton may be transported for further processing.

* * * * *